US005267650A

United States Patent [19]

Gilbilisco

[11] Patent Number: 5,267,650

[45] Date of Patent: Dec. 7, 1993

[54] CHILD RESISTANT DRUG ASSEMBLAGE

[75] Inventor: Kenneth J. Gilbilisco, Coopersburg, Pa.

[73] Assignee: Merck & Co., Inc., Rahway, N.J.

[21] Appl. No.: 961,588

[22] Filed: Oct. 15, 1992

[51] Int. Cl.[5] ..... B65D 83/04

[52] U.S. Cl. ..... 206/534; 206/538; 206/815

[58] Field of Search ..... 206/528, 534, 538

[56] References Cited

U.S. PATENT DOCUMENTS

| | | | |
|---|---|---|---|
| 2,383,367 | 4/1945 | Brown . | |
| 3,033,355 | 5/1962 | Van Sickle . | |
| 3,833,143 | 9/1974 | Starkermann et al. . | |
| 3,888,350 | 6/1975 | Horvath . | |
| 4,038,937 | 8/1977 | Moe | 206/538 X |
| 4,062,445 | 12/1977 | Moe | 206/538 X |
| 4,593,819 | 6/1986 | Will | 206/538 |
| 4,749,085 | 6/1988 | Denney | 206/534 |
| 4,817,819 | 4/1989 | Kelly . | |
| 4,872,559 | 10/1989 | Schoon | 206/538 |
| 5,174,451 | 12/1992 | Niven | 206/538 X |

FOREIGN PATENT DOCUMENTS

| | | | |
|---|---|---|---|
| 2017051 | 9/1979 | United Kingdom | 206/534 |

*Primary Examiner*—William I. Price

*Attorney, Agent, or Firm*—Charles M. Caruso; Carol S. Quagliato

[57] ABSTRACT

A child resistant drug assemblage is disclosed comprising a container having rows of spaced drug cell cavities each of which receives a unit drug dose of medication. The container is provided with a lock means that enables it to be readily opened by an adult but difficult to be opened by a child. Each of the drug dose modules has a plurality of drug cell cavities each of which can hold unit daily doses of a drug.

6 Claims, 4 Drawing Sheets

FIG-2
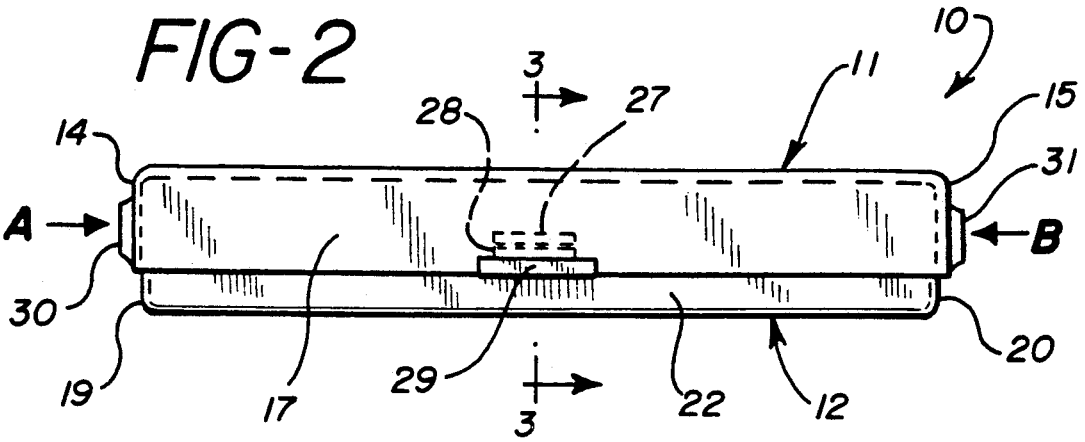
FIG-3
FIG-4
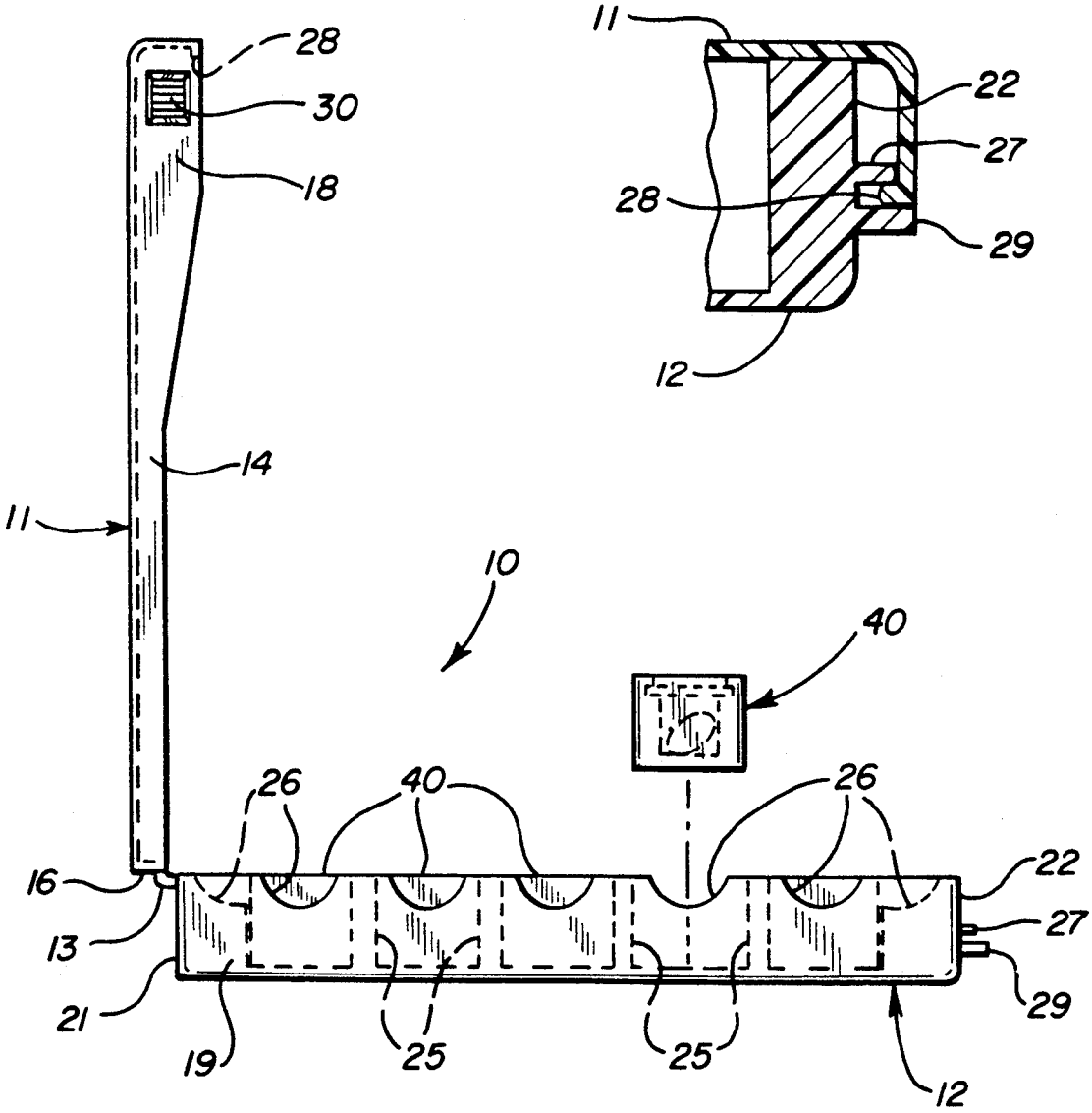

CHILD RESISTANT DRUG ASSEMBLAGE

BACKGROUND OF THE INVENTION

Many medications are dangerous if taken by children or if taken by children in excess. In order to prevent accidental ingestion of medications by children who encounter a medication container, it has been desirable to design medication containers that are resistant to being opened by children.

It has also been desirable to provide medication containers that are simple and easy to use to improve patient compliance and which offer the patient some flexibility so that the only amount of medication required need be carried by the patient when away from home.

SUMMARY OF THE INVENTION

In general, the child resistant drug assemblage of the invention comprises a container having a cover hingeably secured to a compartment section, the compartment section having a plurality of partitions to individually receive a unit drug dose module; lock means to secure said cover to said compartment section; a plurality of spaced drug cell cavities formed in each of said unit drug dose modules; and, means in said unit drug dose modules to receive a slidably removable top cover to overly said drug cell cavities.

In a preferred embodiment, the lock means is a snap-lock assemblage which can be readily disengaged by an adult when manual pressure is appropriately applied to the cover; the unit dose modules are provided with internal grooves to slidably receive the top cover; and, indicia can be provided on the removable top cover in association with each drug cell cavity to identify a day of the week.

In further preferred embodiments, the opposed end walls and/or either or both side walls of the compartment section can have thumb notches formed therein to facilitate removal of one or more unit drug dose modules and one end of the top cover can be provided with a finger tip notch to facilitate sliding it along a unit dose module when accessing a unit dose of medication in the drug cell cavities.

DETAILED DESCRIPTION OF THE INVENTION

The child resistant drug assemblage of the invention will be better understood and preferred embodiments thereof will become more apparent from the ensuing description when considered together with the accompanying drawing wherein like reference numerals denote like parts and wherein:

FIG. 2 is a front end view of the container of FIG. 1 illustrated in a closed position;

FIG. 3 is an enlarged sectional view taken substantially on line 3—3 of FIG. 2 illustrating details of a locking means;

FIG. 4 is a side view of the open container shown in FIG. 1;

Figure 1:
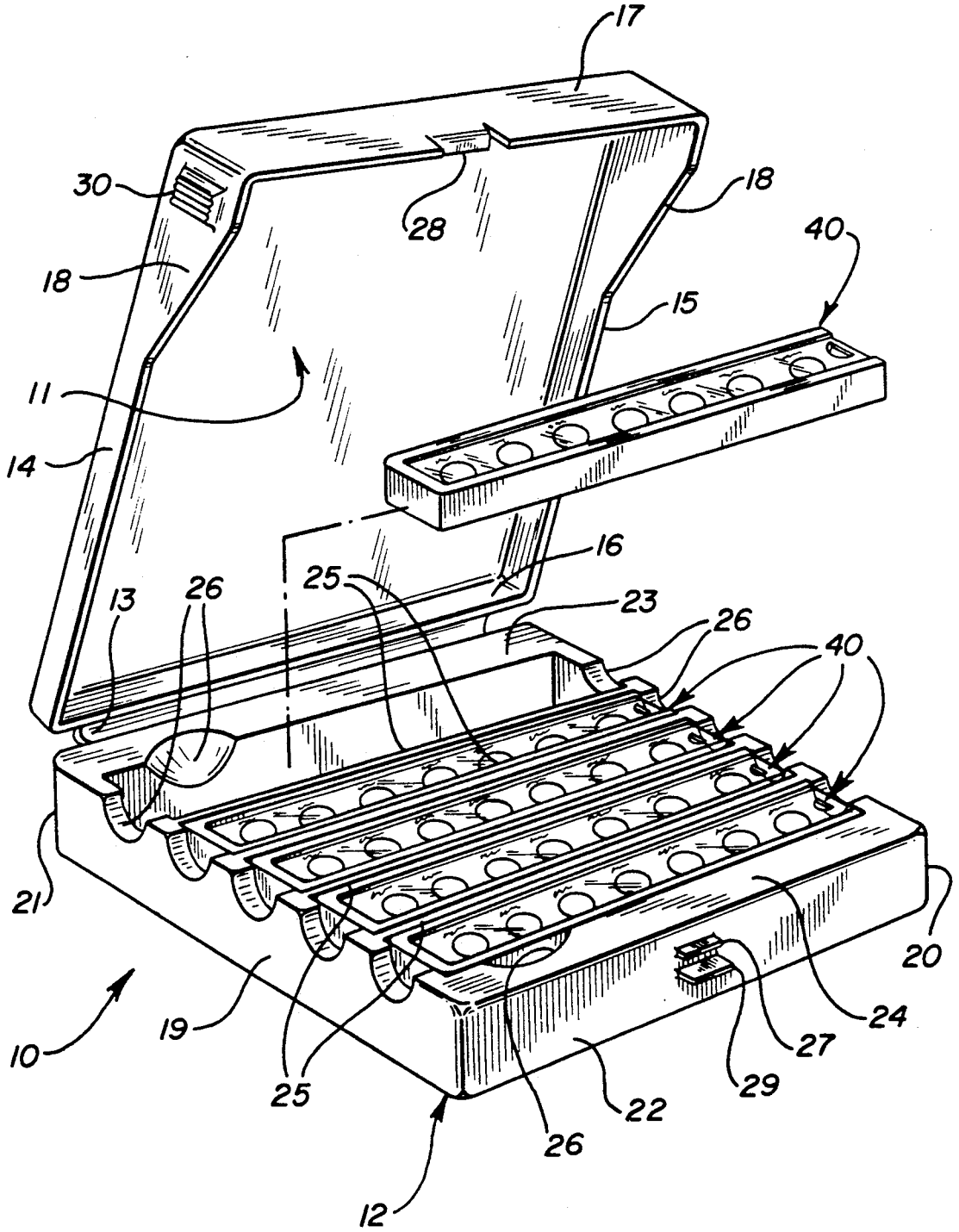
FIG. 1 is a partially exploded perspective view of the drug assemblage of the invention showing the child resistant container and separate unit drug dose modules.

As illustrated in FIG. 1, the child resistant container and separate unit drug dose modules of the invention comprises a container, generally indicated by reference numeral 10, and a plurality of removable, separate drug dose modules, generally indicated by reference numeral 40. Container 10 has a cover 11 and a compartment section 12 which are hingeably secured to one another by conventional hinge means 13 (FIG. 4).

As shown in FIGS. 1-4, cover 11 has opposed depending side walls 14, 15 a depending back wall 16 and an opposed, depending front wall 17. Preferably and as depicted in FIG. 4, the side walls 14, 15 of cover 11 are fabricated to have an enlarged tapered section 18 adjacent front wall 17.

Compartment section 12 has opposed, upwardly projecting side walls 19, 20, an upwardly projecting back wall 21 and an opposed upwardly projecting front wall 22. Preferably, back wall 21 and front wall 22 have inwardly extending thickened sections 23, and 24, respectively (FIG. 1). The interior body of compartment section 12 is preferably provided with a plurality of spaced upwardly projecting partitions 25 which extend transversely between opposed side walls 19, 20 and in which modules 40 are seated as illustrated in FIG. 1. To facilitate removal of one or more modules 40, the thickened sections 23, 24 of back and front walls 21, 22 can have thumb notches 26 formed therein as can either or both side walls 19, 20. (FIGS. 1 and 4).

As clearly shown in FIGS. 1 and 4, cover 11 and compartment section 12 are hingeably secured to each other by hinge means 13 at their common back walls 16 and 21. In addition, cover 11 is sized so that its side walls 14, 15 and front wall 17 overlap side walls 19, 20 and front wall 22 of compartment section 12 when closed and lockably secured to each other.

One means to lockably secure cover 11 and compartment section 12 to each other when closed is illustrated in FIGS. 3 and 4 wherein the outer face of the front wall 22 of the container section is provided with an outward projection 27 intermediate its height and the inner face of the front wall 17 of the cover is provided with an inwardly projecting lip 28 positioned to engage outward projection 27 in a snap-locking assemblage. To prevent cover 11 from being pressed downwardly too severely when snap-locking cover 11 and compartment section 12 together, a stop detent 29 in the form of an elongated outward projection can be provided beneath and spaced from projection 27 as shown in FIGS. 2-4.

In order to facilitate disengagement of the snap-lock assemblage; i.e., disengage lip 28 from projection 27, cover 11 can be grasped at predesignated points 30 and 31 located on opposed side walls 14, 15 (FIG. 2) and inward pressure can be manually exerted by an adult with the fingers of one hand at these points toward the center of cover 11 as indicated by arrows A and B. The inward pressure causes front wall 17 of cover 11 to flex outwardly causing lip 28 to become disengaged from projection 27 whereupon cover 11 can be rotated upwardly by finger tip pressure of the other hand enabling the contents of container section 12 to be accessed. Thus, cover 11 can be readily grasped by an adult in one hand to apply the squeezing pressure necessary to facilitate disengaging the snap-lock assemblage while rotating the cover to its open position with the other hand. It would be difficult for a child to imitate the same manual manipulations as a child's hand will not normally be large enough to span the cover and apply the necessary squeezing pressure.

Figure 5:
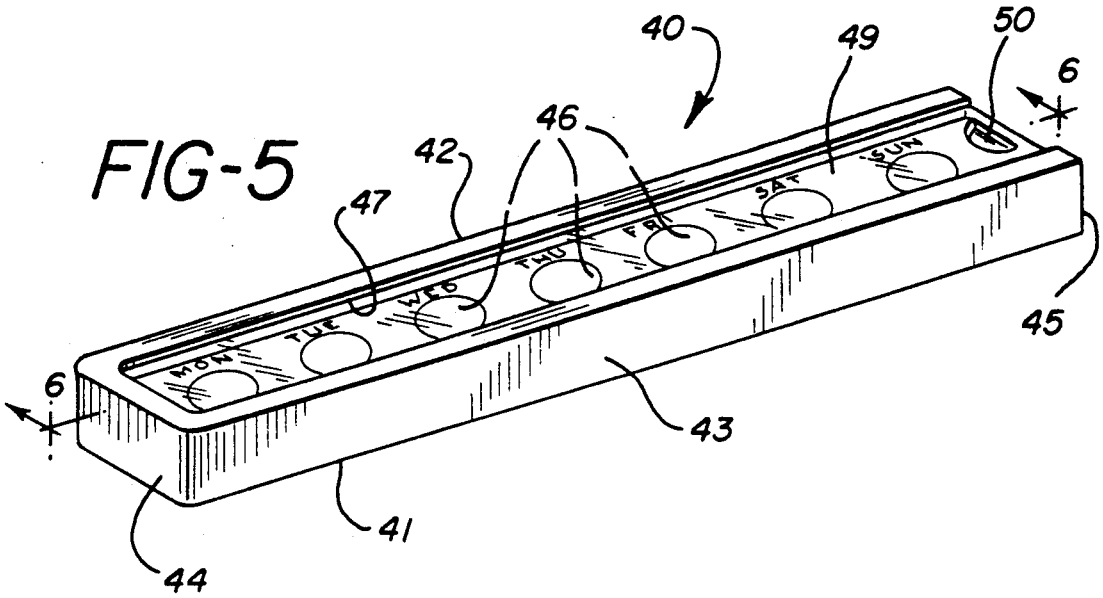
FIG. 5 is a perspective view of a unit dose module of the invention.
Figure 6:
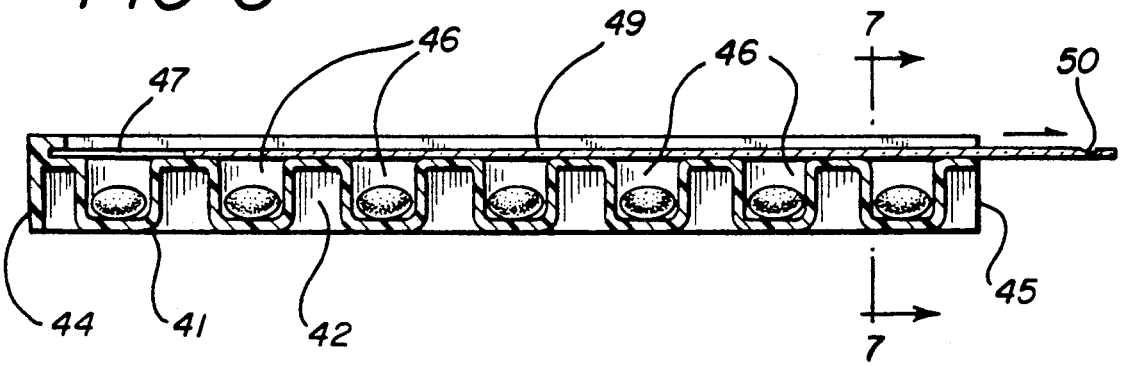
FIG. 6 is a sectional view taken substantially on line 6—6 of FIG. 5 illustrating details of the slidably removable cover.
Figure 7:
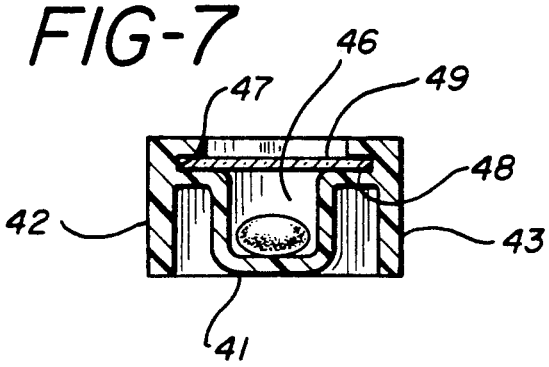
FIG. 7 is a sectional view taken substantially on line 7-7 of FIG. 6.
Figure 8:
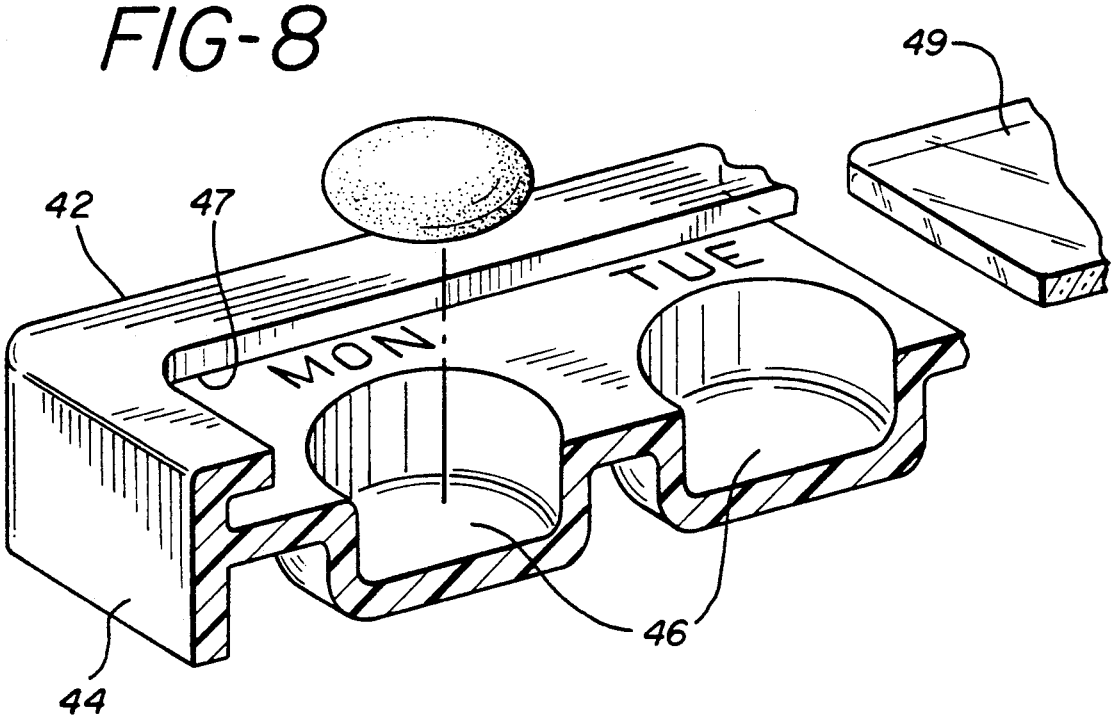
FIG. 8 is an enlarged perspective view, part in section, showing details of the module and the removable cover.

As shown in FIGS. 5–8, each of the separate drug dose modules 40 is generally rectangularly shaped having a bottom 41, opposed side walls 42, 43 and opposed end walls 44, 45. Formed within the body of each module 40 are a plurality of spaced cavities 46 which provide the cells in which unit doses of medication are placed. A pair of opposed grooves 47, 48 are formed adjacent to the upper ends of side walls 42, 43 and extend from one end wall, such as 44, to and through the opposed end wall 45. Grooves 47, 48 serve to slidably receive top closure 49 therein to retain and protect the unit doses of medication placed in cells 46. When the unit doses of medication in cells 46 are to be accessed, top closure 49 can be slid along grooves 47, 48 to expose one or more cells 46 illustrated in FIG. 6. To facilitate sliding top closure 49 in grooves 47, 48, a finger top notch 50 can be provided at that end of top closure where grooves 47, 48 extend through end wall 45 as shown in FIGS. 6, 7, and 8.

To enhance patient compliance, appropriate indicia can be printed adjacent each of the drug cells cavities 46 such as the name of each day in the week. As illustrated in FIGS. 5 and 8 appropriate indicia can be the name of each day in the week.

When indicia such as the days of the week are provided, a corresponding number of drug cells 46 should also be provided in the module; i.e., seven drug cells, one for each day of the week. Accordingly, container section 12 should be sized to receive at least four modules 40, preferably five, to provide a month's supply of a drug regardless of the number of days in a particular month.

Since each module can be readily removed from the container, patient compliance is further enhanced as a patient need not carry the entire container when away from home overnight or on vacation. The patient need only remove and carry the number of modules necessary to provide the required amount of medication needed. The drug cell cavities 46 in the modules 40 should be sized to hold at least one unit dose of a drug regardless of the form of the drug; i.e., tablet, capsule, caplet, or the like. In addition, the drug cells can be sized to accommodate two or more unit doses of a drug when multiple daily dose of a drug are prescribed.

The child resistant drug assemblage of the invention can be made of any suitable materials but moldable plastic is preferred. Polyethylene, either low or high density, can be used as can polypropylene. For cost considerations, low density polyethylene is preferred.

Although the child resistant drug assemblage of the invention has been described with particularity and in detail, it will be apparent to those skilled in this art that modifications can be made therein without departing from the scope of the invention defined in the claims.

What is claimed is:

1. A child resistant drug assemblage comprising a container and a plurality of separate, removable unit drug dose modules in said container, (a) said container comprising:

(i) a cover;

(ii) a compartment section;

(iii) means to hingeably secure said cover to said compartment section;

(iv) means to lockably secure said cover to said compartment section; and, (v) a plurality of partition means within said compartment section to receive a separate unit drug dose modules;

(b) each of said unit drug dose modules comprising:

(i) a plurality of spaced drug cell cavities formed therein; and, (ii) means to slidably receive a removable top closure to overly said cavities.

2. The child resistant drug assemblage of claim 1, wherein said cover has opposed depending side walls, a depending back wall and an opposed depending front wall; said compartment section has opposed, upwardly projecting side walls, an upwardly projecting back wall and an opposed upwardly projecting front wall, the walls of said cover being sized to overlap the side walls of said container section when said assemblage is closed; said hinge means secures the back wall of said cover to the back wall of said compartment section; and, said unit dose modules each have a bottom, and an open top, opposed upwardly projecting side walls and opposed upwardly projecting end walls, each of said side walls having a groove formed therein to receive said slidably removable top closure.

3. The child resistant drug assemblage of claim 2, wherein said compartment section contains partition means comprising a plurality of upwardly projecting spaced walls that extend transversely across said container section between said opposed side walls; and, said locking means is a snap-lock.

4. The child resistant drug assemblage of claim 2, wherein a plurality of spaced notches are formed in the side walls, back wall and front wall of said compartment section; a finger tip notch is formed in one end of said slidably removable cover; and, said slidably removable cover carries indicia imprinted thereon to identify the day of the week of a unit drug dose in said drug cell cavities.

5. A child resistant drug assemblage comprising a container holding a plurality of separate, removable unit drug dose modules, (a) said container comprising:

(i) a cover having opposed depending side walls, a depending back wall and an opposed depending front wall;

(ii) a compartment section having opposed, upwardly projecting side walls, an upwardly projecting back wall and an opposed upwardly projecting front wall, the depending walls of said cover being sized to overlap the upwardly projecting walls of said compartment section when said assemblage is closed;

(iii) means to hingeably secure the depending back wall of said cover to the upwardly projecting back wall of said compartment section;

(iv) cooperating means on the upwardly projecting front wall of said compartment section and the depending front wall of said cover to snap-back said cover to said compartment section; and, (v) a plurality of upwardly projecting spaced walls within said container section extending transversely between said opposed side walls of said container section forming partitions to receive separate unit drug dose modules therebetween;

(b) each of said unit drug dose modules comprising:

(i) a bottom, an open top, opposed upwardly projecting side walls and opposed upwardly projecting end walls;

(ii) a plurality of spaced drug cell cavities formed within said opposed side and end walls;

(iii) a groove formed adjacent the upper end of each of said opposed side walls extending from one end wall to and through said opposed end wall; and, (iv) a removable top cover sized to slidably engage said grooves and to overly said drug cell cavities.

6. The child resistant drug assemblage of claim 5, wherein the side walls, back wall and front wall of said compartment section have a plurality of thumb notches formed therein; one end of said top cover has a finger tip notch formed therein; and, said top cover carries indicia imprinted thereon to identify the day of the week of a unit drug dose in said drug cell cavities.

* * * * *